United States Patent [19]

Matsumoto et al.

[11] Patent Number: 4,631,181

[45] Date of Patent: Dec. 23, 1986

[54] PROCESS FOR PRODUCING MESOPHASE PITCH

[75] Inventors: Mitsuaki Matsumoto; Masatosi Furuyama; Tadao Tomioka; Hirofumi Sunago; Masakazu Higuchi, all of Kawasaki, Japan

[73] Assignees: Nippon Steel Corporation; Nippon Steel Chemical Co., Ltd., both of Tokyo, Japan

[21] Appl. No.: 717,069

[22] Filed: Mar. 28, 1985

[30] Foreign Application Priority Data

Mar. 31, 1984 [JP] Japan ..... 59-64227
Mar. 31, 1984 [JP] Japan ..... 59-64228

[51] Int. Cl.[4] ..... C01B 31/02; C09C 1/48; C10C 1/00; C10C 1/20

[52] U.S. Cl. ..... 423/449; 423/445; 423/448; 208/22; 208/39; 208/44

[58] Field of Search ..... 423/445, 448, 449; 208/44, 39, 22

[56] References Cited

U.S. PATENT DOCUMENTS

| | | | |
|---|---|---|---|
| 3,235,482 | 2/1966 | Knoules et al. | 208/39 |
| 4,202,868 | 5/1980 | Hayashi et al. | 423/448 |
| 4,209,500 | 6/1980 | Chwastiak | 423/449 |
| 4,277,325 | 7/1981 | Greenwood | 208/22 |
| 4,379,133 | 4/1983 | Zander et al. | 423/445 |
| 4,579,645 | 4/1986 | Vemura et al. | 208/22 |

FOREIGN PATENT DOCUMENTS

| | | | |
|---|---|---|---|
| 59-9221 | 1/1984 | Japan | 423/449 |

*Primary Examiner*—Gregory A. Heller
*Attorney, Agent, or Firm*—Pollock, Vande Sande & Priddy

[57] ABSTRACT

A mesophase pitch suitable for carbon products, particularly for carbon fibers, which has a mesophase content of at least 40%, preferably at least 60%, and a larger mesophase domain, is produced by adding at least one part by weight of at least one of an alcohol and a phenol to 100 parts by weight of heavy bitumens, subjecting the resulting mixture to pretreatment by heating at least at 250° C., and then subjecting the pretreated mixture to heat treatment until mesophases are formed.

13 Claims, 9 Drawing Figures

PROCESS FOR PRODUCING MESOPHASE PITCH

BACKGROUND OF THE INVENTION

1. Field of the Invention

This invention relates to a process for producing a mesophase pitch for high quality carbon products such as carbon fibers, needle-like pitch cokes, etc., and carbon products, particularly carbon fibers, produced from the mesophase pitch.

2. Description of the Prior Art

Carbon products such as carbon fibers, needle-like cokes or synthetic graphite electrodes made of the mesophase pitch as raw material have a graphite-like crystal structure, and thus have distinguished mechanical and electrical characteristics such as high Young's modulus, high electroconductivity, etc.

According to the conventional process for producing carbon products from pitches, the softening point, molecular weight, etc. of a pitch are adjusted by heat treatment, extraction, etc. to give a raw material for carbon products. Thus prepared pitch is then molded into desired shapes, for example, fiber form, etc., and carbonized or graphitized.

Generally, optically anisotropic portions called "mesophase" are formed in an optically isotropic pitch, as the pitch is heated, and the mesophase portions gradually increase in their proportion through repetition of their growth, agglomeration, and deformation.

The mesophase has a liquid crystal structure in which planar condensed aromatic molecules are regularly oriented. Mesophase pitch having a high degree of orientation can be readily converted to graphite-like crystals by carbonization and graphitization, and thus carbon products having a well developed graphite-like structure can be obtained from such a mesophase pitch.

On the other hand, the production of carbon products from a pitch requires a molding step, and thus the pitch must have a good moldability. To this end, the mesophase pitch must have a good flowability.

For example, in the production of carbon fibers from a pitch, the degree of crystal size and the degree of crystal orientation in carbon fibers greatly depend on whether the condensed aromatic molecules in the pitch for carbon fibers can be oriented in the axial direction of fibers in the melt-spinning step or not. Thus, it can be said that the desirable pitch for the carbon fibers must be a mesophase pitch containing a group of regularly oriented condensed aromatic molecules and also must have a sufficient flowability. These are common requirements for all the raw material pitches for synthetic graphite products.

Usually the condensed aromatic molecules grow larger and the content of mesophase becomes higher. The regularity and orientation are improved, but at the same time the softening point will become higher, resulting in a lower flowability and poorer workability. In the production of carbon fibers, the pitch having a substantially 100% mesophase content can hardly flow when subjected to melt-spinning. When the spinning temperature is elevated to obtain a sufficient flowability, the pitch will be partially decomposed or sometime coked.

Thus, it has been so far desired in the production of a raw material pitch for carbon products to produce a mesophase pitch having a lower softening point, in other words, a pitch having a higher mesophase content, so long as the softening point is on the same level.

In the case of a mesophase pitch having a good flowability, mesophase spherulites themselves can readily agglomerate mutually during heat treatment to give large domains or continuous mesophases can be developed. Solubility in a solvent such as quinoline, etc. is one of indices for evaluating the characteristics of the mesophase pitch. A mesophase pitch containing a quinoline-soluble mesophase has a lower melting point and a higher flowability, and thus has an advantage of easy melt-spinning for the production of carbon fibers. Thus, a mesophase pitch has been now regarded as the most desirable raw material for producing high performance carbon fibers, and studies of the processes have been so far extensively made. Some of the so far proposed processes for producing a mesophase pitch containing a quinoline-soluble mesophase are given below:

U.S. Pat. No. 4,209,500 discloses production of a mesophase pitch having a substantially 100% mesophase content and containing a pyridine-soluble mesophase by passing an inert gas through a pitch heated and stirred at 380° to 430° C., where a treatment time of 2 to 60 hours and a large amount of the inert gas are required.

U.S. Pat. No. 4,208,267 discloses production of pitch portions, which can be readily converted to a mesophase pitch containing a quinoline-soluble mesophase by treating a pitch with a specific solvent, where the pitch portions are called neomesphase-forming fractions (NMF fractions), but the NMF fractions obtainable from the pitch are very small.

U.S. Pat. No. 4,184,942 discloses an increased production of NMF fractions by heat-treating a pitch in advance, followed by separation of NMF fractions, where the heat treatment, solvent extraction, and further heat treatment must be carried out, resulting in complicating of the process.

As described above, the prior art processes require a large amount of a special gas, or a specific solvent, or a complicated process or prolonged treatment time for producing a mesophase pitch containing a quinoline-soluble mesophase, and thus still have problems to be solved.

SUMMARY OF THE INVENTION

An object of the present invention is to provide a process for producing a novel mesophase pitch free from the problems of the prior art processes.

Another object of the present invention is to provide a process for producing a mesophase pitch having a mesophase content of at least 40%, a low softening point and an improved flowability.

Another object of the present invention is to provide a mesophase pitch having a high quinoline-soluble mesophase content and large domains of mesophase.

Still another object of the present invention is to provide carbon products, particularly carbon fibers, produced from the said mesophase pitch as a raw material.

According to the present invention, a mesophase pitch having a mesophase content of at least 40% can be produced by adding at least one of an alcohol and a phenol to heavy bitumens, pretreating the resulting mixture by heating at a temperature of at least 250° C. for at least 5 minutes, and further by heat-treating the pretreated mixture until mesophases are formed.

DETAILED DESCRIPTION OF THE INVENTION

Figure 1:
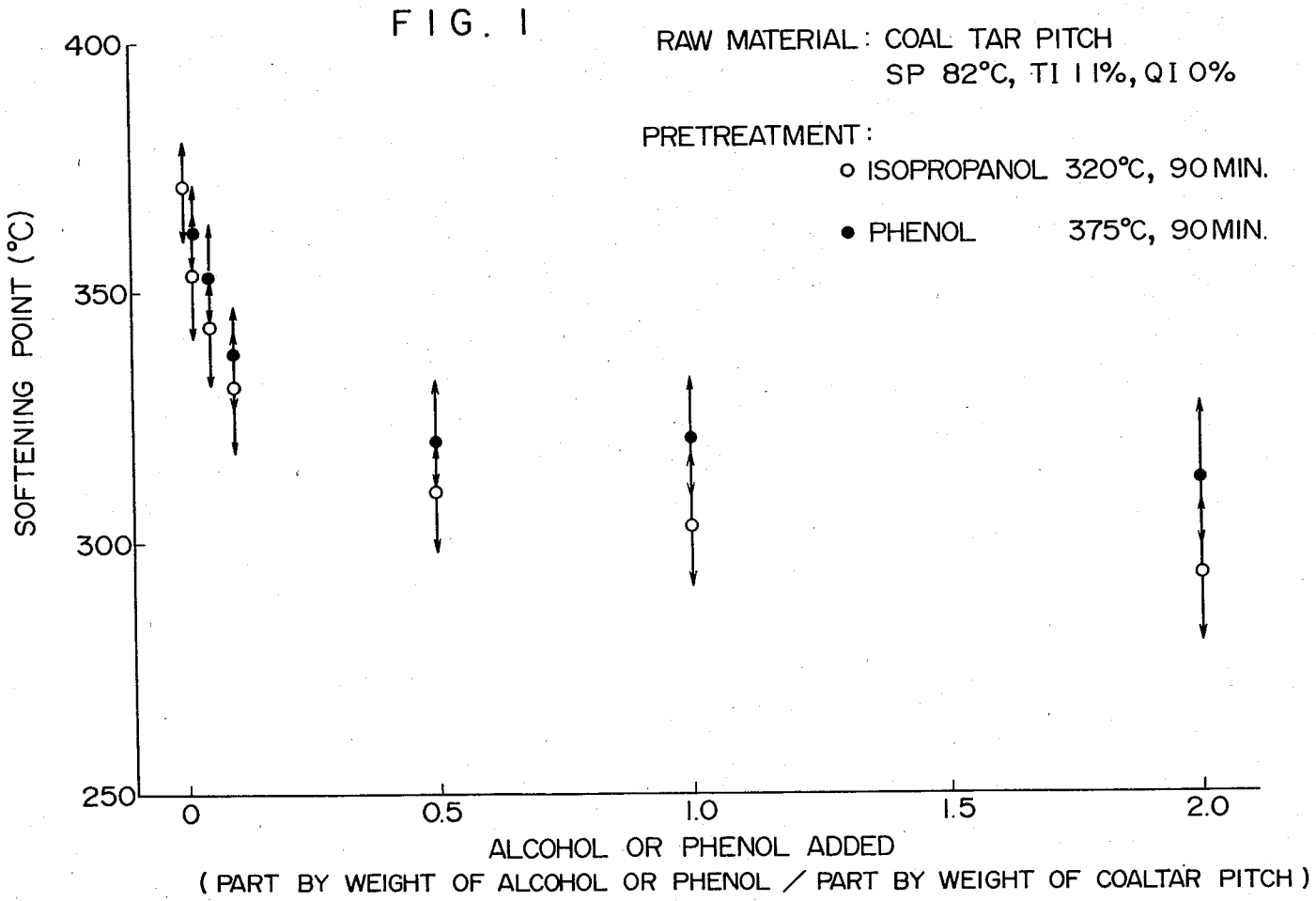
FIG. 1 is a diagram showing the relationship between the amount of alcohol or phenol added to a coal tar pitch in the pretreatment and the softening point of the resulting mesophase pitches having a mesophase content of 70% after the heat treatment according to the present invention.

The present invention will be described in detail below. As a result of extensive studies on the production of a mesophase pitch for high performance carbon products which can overcome the said drawbacks of the prior art processes, the present inventors have found that a mesophase pitch suitable for higher performance carbon products can be obtained by adding at least one of an alcohol and a phenol to heavy bitumens, and pretreating the resulting mixture by heating, and further heat-treating the pretreated mixture, and have established the present invention.

The term "mesophase" herein used refers to an optically anisotropic structure which can be determined by observing the polished surface of a cooled and solidified pitch by a polarization microscope. The mesophase content of the mesophase pitch refers to a proportion of the anisotropic structure thus determined.

The function of an alcohol so far used in relation to the heavy bitumens has been nothing but that of an extracting agent for extracting an oil fraction as unsuitable matters for producing the carbon products from the heavy bitumens. A major portion or most of the heavy bitumens is insoluble in an alcohol, and the alcohol as a treating agent for the heavy bitumens for producing carbon products has not been taken into account at all. Furthermore, in the production of carbon products from the raw material heavy bitumens, it has been only known that oxygen, sulfur, etc. contained in the raw material will inhibit graphitization through a carbonizing step in the process for obtaining carbon products and that the reaction of heavy bitumens with an alcohol would add more oxygen to the bitumens, and thus is not regarded at all as a means for producing a raw material pitch for producing the carbon products in the conventional sense.

Heretofore, the reaction of heavy bitumens with a phenol or successive heat treatment have not been studied at all. Phenols are contained in coal tar, coal-liquefied oil, etc. as raw materials for pitch. According to the conventional process for producing pitches as their heavy residues, phenols are removed in advance with a chemical such as caustic soda, etc., or stripped together with an oil fraction by distillation, and thus no phenols are contained in the pitches as the heavy residues.

Pitches are used substantially as a raw material for carbon products, and the oxygen in the raw material has been regarded, together with sulfur, etc. as inhibiting matters for graphitization of carbon products. Thus, in the conventional production of pitches for carbon product, phenols are intentionally removed from the raw material heavy bitumens on this ground. According to an extreme case, a phenol-aldehyde resin which can be synthesized from phenol as one of raw materials is a typical raw material for non-graphitized carbon products [S. Ohtani and Y. Sanada: Tansoka KogaKu Kogaku-no Kiso (Foundation of Carbonizing Technology), published by Ohm Publishing Company, Tokyo (1980), page 117].

Thus, the reaction with a phenol and successive heat treatment have not been so far regarded at all as a means for producing a raw material for carbon products that require a graphite-like structure in the conventional sense.

The present inventors have made extensive studies of reactions of heavy bitumens with various compounds contrary to the said conventional sense, and have found that a mesophase pitch having more distinguished properties and applicable as a raw material for producing carbon products than the pitch obtained by mere heat treatment of heavy bitumens can be produced by pretreating heavy bitumens with at least one of an alcohol and a phenol by heating, and heat-treating the pretreated mixture until mesophases are formed in the mixture.

Heavy bitumens for use in the present invention includes, for example, coal tar, coal-liquefied heavy oil, petroleum-topping bottoms, petroleum cracking bottoms, and pitch fractions prepared from these oils and bottoms, and in view of the yield of pitch for the carbon products, the so called pitch fraction cut from the oil fractions is preferable. The pitch can be obtained by separating a portion or the whole of an oil fraction from coal tar, coal-liquefied oil, petroleum cracking bottoms, etc. containing the pitch matters, or also by converting heavy coal tar oil, etc. containing no pitch matters to a pitch. In any way, a pitch contains hydrocarbons having condensed aromatic rings as major components, and a pitch having a softening point of 0° to 200° C. is a preferable raw material. Particularly preferable is a coal tar pitch having a softening point of 30° to 150° C.

The alcohol for use in the present invention includes compounds having an alcoholic hydroxyl group, for example, saturated alcohols such as methanol, ethanol, propanol, butanol, pentanol, hexanol, heptanol, octanol, etc.; unsaturated alcohols such as allyl alcohol, etc.; halogenoalcohols such as ethylene chlorohydrin, etc.; polyhydric alchols such as ethylene glycol, diethylene glycol, triethylene glycol, glycerine, etc.; aminoalcohols such as ethanolamine, etc., and can be used alone or in a mixture thereof. For example, distillation bottoms of alcohol, etc. can be also used.

The phenol for use in the present invention includes compounds having a phenolic hydroxyl group, for example, monohydric phenol such as phenol, cresol, xylenol, etc., dithydric phenols such as resorcinol, hydroquinone, etc.; polyhydric phenols such as hydroxyhydroquinone, etc., and can be used alone or in a mixture thereof. For example, distillation bottoms of phenol, etc., can be also used.

At least one part by weight, preferably at least two parts by weight, more preferably at least 5 parts by weight of at least one of an alcohol and a phenol is added to 100 parts by weight of heavy bitumens. Hereinafter "parts by weight" will be referred to merely by "parts". Below one part, the softening point of the resulting mesophase pitch for the carbon products is less lowered, whereas, above 200 parts, there is no remarkable effect on lowering of the softening point.

In the present invention, it is important to add at least one part of at least one of an alcohol and a phenol from the outside to 100 parts of heavy bitumens. FIG. 1 graphically shows the relationship between the amount of an alcohol or a phenol added to a coal tar pitch in the pretreatment and the softening point of the resulting mesophase pitches after the heat treatment.

The pretreatment of heavy bitumens with at least one of an alcohol and a phenol is carried out by heating at a 250° C. or higher, preferably in a range of 300° to 550° C.

The pretreatment means a thermal reaction in which the heavy bitumens and at least one of an alcohol and a phenol take part. At a lower temperature than 250° C., no thermal reaction proceeds, whereas at a higher temperature than 550° C., the coking reaction of heavy bitumens vigorously proceeds. The pretreatment time depends on the heating temperature, and for less than 5 minutes the reaction does not proceed substantially, with less effect on the lowering of the softening point of mesophase pitch. For a prolonged pretreatment time, the coking reaction may be initiated due to the pretreatment at a higher temperature to the contrary, and no better effect will be obtained on the lowering of the softening point. Thus, the pretreatment time of up to about 5 hours will be enough.

In the pretreatment, it is necessary to seal an alcohol or a phenol in the heavy bitumens, and thus the pretreatment is carried out under a higher pressure than the autogeneous pressure of the alcohol or the phenol. When the boiling point of an alcohol or a phenol is low, the pressure may often exceed its critical point.

The effects of the pretreatment are given below:

Mesophases are formed in the heavy bitumens by heat-treating the pretreated mixture of the heavy bitumens and at least one of an alcohol and a phenol. As the heat treatment is intensified, the proportion of mesophases is increased, resulting in ultimate coking. With increasing mesophase content, the softening point of mesophase pitch will be elevated. As shown in FIG. 1, the softening point of mesophase pitch obtained from the coal tar pitch pretreated with an alcohol or a phenol by pretreatment is a few to a few tens ° C. lower than that of the mesophase pitch obtained from the coal tar pitch prepared without the pretreatment if the mesophase content is on the same level. This suggests that the mesophase pitches obtained in this invention have a higher flowability.

Observation through a polarization microscope of a microstructure of mesophase pitches having continuous mesophases, obtained by pretreatment of at least one of an alcohol and a phenol and also without the pretreatment, reveals, as shown in FIGS. 2 to 9, that the mesophases obtained from the heavy bitumens pretreated by at least one of an alcohol and a phenol has larger domains than those of the mesophase obtained without the pretreatment, if the mesophase content is on the same level, that is, has less defects in lamination of planar condensed aromatic molecular layers.

It is obvious from the foregoing that the mesophase pitch obtained according to the present invention has a higher flowability than the mesophase pitch obtained from the heavy bitumens without the pretreatment with at least one of an alcohol and a phenol, that is, only by the heat treatment.

Details of mechanism of the pretreatment of heavy bitumens with at least one of an alcohol and a phenol have not been clarified yet. However, it has been found that the following products have been formed when an alcohol was added to the heavy bitumens. That is, proton nuclear magnetic resonance ('H-NMR) spectra of the oil fraction from coal tar pitch pretreated with isopropanol reveals that a peak formation characteristic of acetone at δ value of 2.1 ppm, which is not contained in the raw material coal tar pitch, is observable. According to infrared (IR) spectra of an oil fraction from the coal tar pitch pretreated with n-butanol or sec-butanol, peaks of carbonyls, which are not contained in the raw material coal tar pitch, appear at about 1640 $cm^{-1}$ and about 1700 $cm^{-1}$. Thus, it seems that the hydrogen is transferred from the alcohol to the coal tar pitch, while the alcohol itself is converted to a carbonyl compound, but as is obvious also from the said example of isopropanol, the carbonyl can be formed from only a small amount of the added alcohol, while a considerable amount of the alcohol remains as such in the pitch. It also seems that the thermal reaction of pitch becomes peculiar in the presence of an alcohol. Details of the mechanism thus has not been clarified yet.

Said effects obtained by pretreatment of heavy bitumens with a phenol seem to be due to the fact that the thermal reaction of heavy bitumens is made peculiar by the addition of a phenol thereto, but the details of reaction mechanism have not been clarified yet, either.

Lowering of the softening point of the mesophase pitch obtained by pretreatment of heavy bitumens with at least one of an alcohol and a phenol and by successive heat treatment depends on the amount of at least one of the alcohol and phenol added. In FIG. 1, changes in softening points of mesophase pitches are plotted against the amount of the isopropanol or phenol added for pretreating the coal tar pitch. In this case, pretreatment conditions are set with varied amounts of isopropanol or phenol at 320° C. or 375° C., 90 minutes, under the autogeneous pressure. Then, the pretreated pitches are heat-treated at various temperatures under various pressures for various periods of time. Thus, the mesophase pitches having various mesophase contents are obtained. These softening points are closely related to mesophase contents in range of 10–90%. Thus, the softening points of mesophase pitch having 70% mesophase contents are determined and the softening points are plotted against the amount of the isopropanol or phenol added for pretreating the coal tar pitch. It is obvious from FIG. 1 that the softening point can be considerably lowered by adding even a small amount of an alcohol or a phenol for pretreatment.

The effects of lowering the softening point of a mesophase pitch are remarkable in the production of carbon fibers from the mesophase pitch. Pitch-based carbon fibers are produced at first by melt-spinning the mesophase pitch, and usually spinning of the mesophase pitch is carried out at a temperature 20° to 60° C. higher than the softening point. At a higher spinning temperature, a portion of the pitch undergoes thermal decomposition, resulting in gas generation or coking. Thus, the spinning temperature itself has an upper limit, which is about 380° to about 400° C. On the other hand, it is said that the carbon fibers produced from the mesophase pitch can be distinguished in physical properties such as modulus of elasticity, etc., only when the mesophase pitch for spinning has a higher mesophase content, for example, 40% or higher, preferably 60% or higher.

Even if the heavy bitumens are heat-treated according to the present invention until a higher mesophase content is obtained, the softening point can be made lower by a few to a few tens ° C. than that of the heavy bitumens without the pretreatment with at least one of an alcohol and a phenol. This means that the mesophase pitch having even a higher mesophase content can be spun satisfactorily into carbon fibers, and thus the present invention is very advantageous for producing high quality carbon fibers. To obtain such effects, it is desirable to add at least one part, preferably at least two parts, more preferably at least five parts of at least one of an alcohol and a phenol to 100 parts of the heavy bitumens, and conduct pretreatment of the resulting mixture by heating. The pretreatment is desirably carried out under pressure for at least 5 minutes, as described before.

In the pretreatment, the softening point of a mesophase pitch, or lowering of the lowering of pretreatment temperature, shortening of reaction time, and reduction in the amount of at least one of an alcohol and a phenol can be attained by adding 0.01 to 5 parts of a basic substance such as caustic alkali, alkali carbonate, tar bases, etc. to 100 parts of heavy bitumens. For example, when 100 parts of isopropanol were added to 100 parts of coal tar pitch, and one part of caustic potassium was added thereto as a basic substance, and when the pretreatment was carried out at 320° C. under pressure for 90 minutes and an oil fraction was removed therefrom by distillation after the pretreatment, it was found by 'H-NMR spectrum measurement of the oil fraction that acetone was formed in an amount about 3 times as large as that obtained when no basic substance was added, and also it was found that the mesophase pitch obtained by successive heat treatment had a softening point about 20° C. lower than that of the mesophase pitch obtained by the pretreatment without the basic substance and by the successive heat treatment under the same conditions.

After the pretreatment of heavy bitumens, a mesophase pitch having a mesophase content of at least 40% can be obtained by successive heat treatment. The successive heat treatment for mesophase formation can be carried out according to the conventional procedure, for example, by heating at 350° to 500° C. under reduced pressure, by heating at 350° to 500° C. with blowing of an inert gas, or by heating under the atmospheric pressure, followed by conducting distillation under reduced pressure or blowing of an inert gas to remove an oil fraction therefrom and to increase the mesophase content. In any heat treatment procedure, those skilled in the art can readily determine, through easy experiments, conditions for producing a mesophase pitch having a desired mesophase content for carbon products, such as heat treatment temperature, heat treatment time, degree of pressure reduction, amount of inert gas, etc. A typical mesophase pitch can be obtained by heat treatment at 400° C. or higher under a pressure of 50 Torr or lower.

It is preferable to remove low boiling components such as unreacted alcohol or phenol or formed aldehydes, ketones and so on from the pretreated heavy bitumens before the heat treatment. The removal can be carried out by distillation, settling, centrifuge, etc. However, the heat treatment is usually carried out at an elevated temperature under the atmospheric pressure or reduced pressure, or together with blowing of an inert gas, and thus the formed low boiling components can be removed spontaneously without any intentional separation in advance. Thus, the pretreated heavy bitumens can be transferred from the pretreatment directly to the heat treatment for mesophase formation. An alcohol is less soluble in the heavy bitumens, and can undergo phase separation only by settling the pretreated mixture. Thus, it is convenient to remove the alcohol therefrom by the settling. A phenol has a large difference in boiling point from the heavy bitumens, and thus it is preferable to remove the phenol therefrom by distillation.

Quinoline-insoluble matters in the heavy bitumens usually lower the quality of mesophase pitch for carbon products. Particularly in the case of carbon fibers, the presence of quinoline-insoluble matters is not preferable, because they may clog spinning nozzles during the spinning. It may be sometimes necessary to remove the quinoline-insoluble matters from the raw material heavy bitumens also in the present invention, depending on the end use. Such removal can be carried out, before or after the pretreatment with at least one of an alcohol and a phenol, according to the conventional procedures, for example, by solvent extraction using quinoline or other solvents, melt filtration, centrifuge, etc.

High quality carbon products such as carbon fibers, needle-like pitch cokes, etc. can be produced from the present mesophase pitch according to the conventional procedures. For example, carbon fibers or graphitized fibers can be produced by melt-spinning the present mesophase pitch at a temperature 20° to 60° C. higher than the softening point, thermosetting the spun fibers in an atmosphere of air or oxygen, etc., and then heating the fibers at 1,000° to 2,000° C. in an inert atmosphere, or successively at 2,000° to 3,000° C.

The present mesophase pitch has a lower melting point in contrast to the higher mesophase content, and thus can be melt-spun at a lower spinning temperature, and thus high quality carbon fibers can be readily and stably produced from the present mesophase pitch without coking.

PREFERRED EMBODIMENTS OF THE INVENTION

The present invention will be described in detail below, referring to Examples, Comparative Examples, and Drawings, where the ratio of materials is expressed in parts and percentages are by weight, unless otherwise mentioned.

EXAMPLE 1

100 parts of coal tar pitch (A) having a softening point of 82° C., 11% toluene insolubles (T1) and 0% quinoline-insolubles (QI) and 50 parts of isopropanol were charged into an autoclave, and subjected to pretreatment by heating at 320° C. for 90 minutes after the air in the autoclave was replaced with a nitrogen gas and the autoclave was tightly sealed. The pretreatment pressure was 80 kg/cm$^2$ gage.

After the pretreatment, the resulting pretreated mixture was cooled, and a supernatant containing unreacted isopropanol was removed thereform by decantation.

Figure 2:
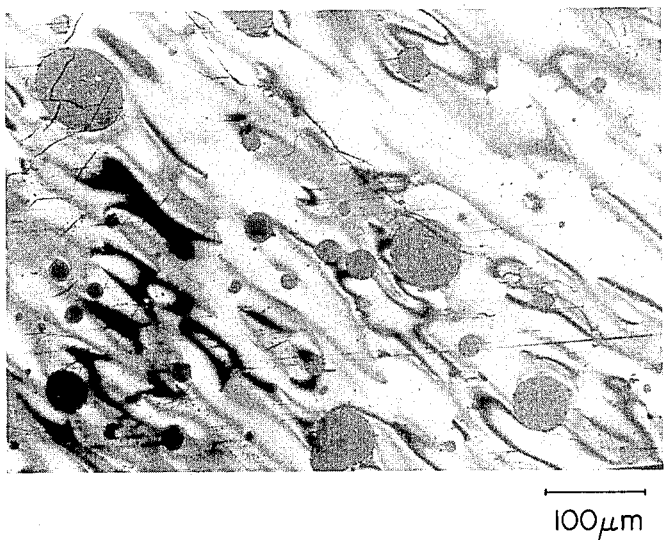
FIG. 2 is a picture, taken through a polarization microscope, of a mesophase pitch microstructure obtained by pretreating a coal tar pitch (A) with an alcohol, followed by heat treatment.

The pitch residue was then taken into a test tube, and subjected to heat treatment by heating at 450° C. under 4 Torr in a nitrogen atmosphere for 15 minutes to obtain a mesophase pitch. A picture of the mesophase pitch, taken through a polarization microscope, is shown in FIG. 2. It is seen that the mesophase domains are larger than those of FIG. 6.

COMPARATIVE EXAMPLE 1

Figure 6:
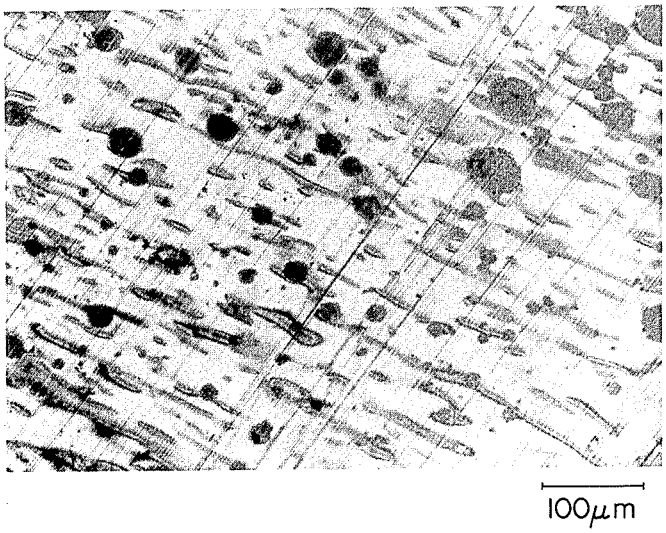
FIGS. 6, 7, 8 and 9 are pictures, taken through a polarization microscope, of a mesophase pitch microstructure obtained by heat-treating coal tar pitch (A), coal tar pitch (B), coal tar soft pitch (C), and petroleum pitch (D) without pretreatment with an alcohol or a phenol, respectively.

Coal tar pitch (A) was taken into test tubes without pretreatment and subjected directly to heat treatment under the same conditions as in Example 1, except that the heat treatment time was changed variously to obtain mesophase pitches having various mesophase contents. FIG. 6 shows the picture of mesophase pitch having about the same mesophase content as that of Example 1 as shown in FIG. 2.

EXAMPLE 2

100 parts of coal tar pitch (B) having a softening point of 82° C., 11% toluene insolubles and 0% quinolineinsolubles and 50 parts of phenol were charged into an autoclave, and subjected to pretreatment by heating at 375° C. for 90 minutes after the air in the autoclave was replaced with a nitrogen gas and the autoclave was tightly sealed. The pretreatment pressure was 20 kg/cm$^2$ gage.

After the pretreatment, an oil fraction was removed from the resulting mixture by distillation at 300° C. under 10 Torr.

Figure 3:
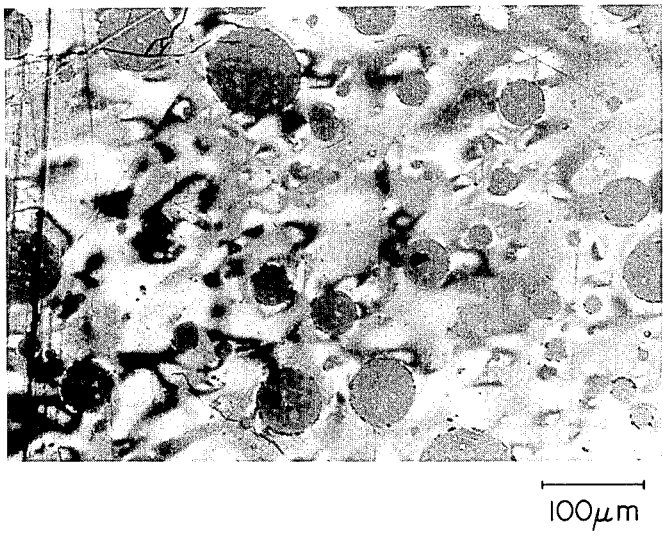
FIG. 3 is a picture, taken through a polarization microscope, of a mesophase pitch microstructure obtained by pretreating coal tar pitch (B) with a phenol, followed by heat treatment.

Then, the pitch residue was then taken into a test tube, and subjected to heat treatment by heating at 450° C. under 4 Torr in a nitrogen atomosphere for 15 minutes to obtain a mesophase pitch. A picture of the mesophase pitch, taken through a polarization microscope, is shown in FIG. 3. It is seen that the mesophase domains are larger than those of FIG. 7.

COMPARATIVE EXAMPLE 2

Figure 7:
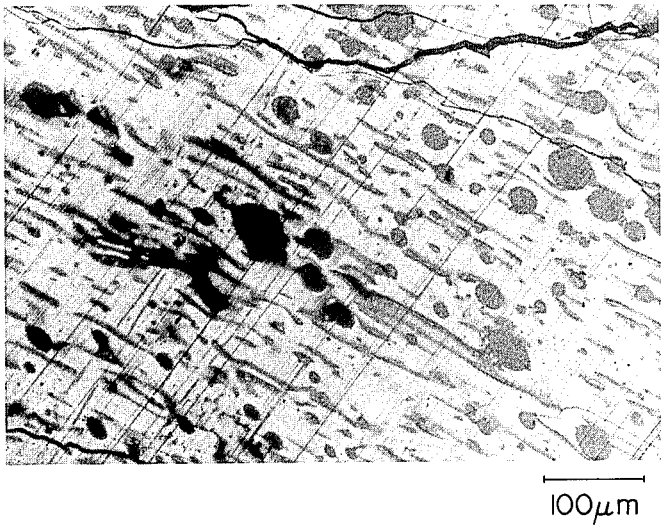

Coal tar pitch (B) was taken into test tubes without pretreatment and subjected directly to heat treatment under the same conditions as in Example 2, except that the heat treatment time was changed variously to obtain mesophase pitches having various mesophase contents. FIG. 7 shows the picture of mesophase pitch having about the same mesophase content as that of Example 2 as shown in FIG. 3.

EXAMPLE 3

Coal tar soft pitch (C) having a softening point of 36° C., 11% TI and 5% QI was filtered with heating to obtain a pitch having a softening point of 36° C., 11% TI and a trace of QI.

Then, 100 parts of the filtered pitch and 200 parts of isopropyl alcohol were charged into an autoclave, and subjected to pretreatment by heating at 335° C. for 90 minutes after the air in the autoclave was replaced with a nitrogen gas and the autoclave was tightly sealed. The pretreatment pressure was 131 kg/cm$^2$ gage.

After the pretreatment, an oil supernatant containing unreacted isopropyl alcohol was separated from the resulting mixture by decantation.

Figure 4:
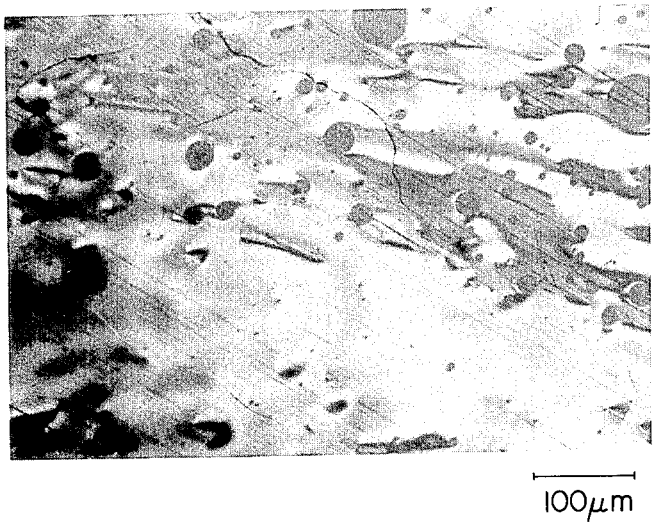
FIG. 4 is a picture, taken through a polarization microscope, of a mesophase pitch microstructure obtained by pretreating coal tar soft pitch (C) with an alcohol, followed by heat treatment.
Figure 5:
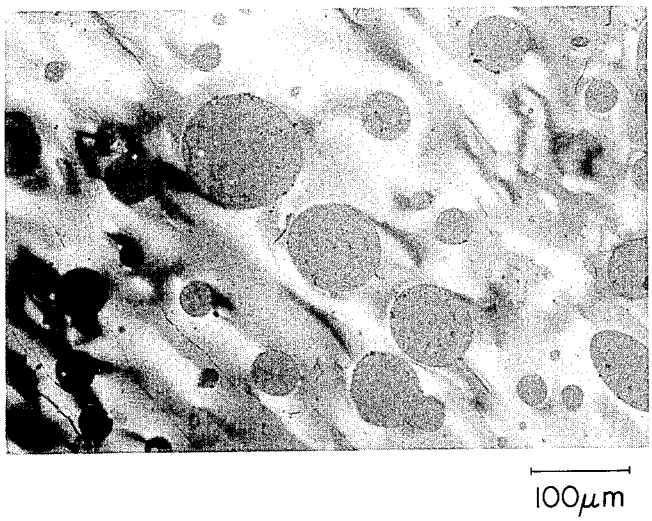
FIG. 5 is a picture, taken through a polarization microscope, of a mesophase pitch microstructure obtained by pretreating petroleum-based heavy oil pitch (D) with an alcohol, followed by heat treatment.

Then, the pitch residue was taken into a test tube, and subjected to heat treatment by heating at 470° C. under 10 Torr in a nitrogen atmosphere for 15 minutes to obtain a mesophase pitch. After cooling, the surface of the mesophase pitch was polished and observed by a polarization microscope. The surface was as shown in FIG. 4 and it is seen therefrom that the mesophase domains are larger than those of FIG. 8.

COMPARATIVE EXAMPLE 3

Figure 8:
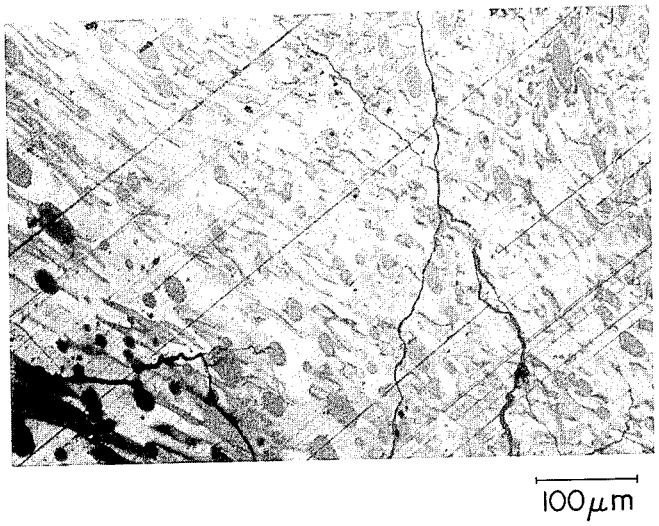
Figure 9:
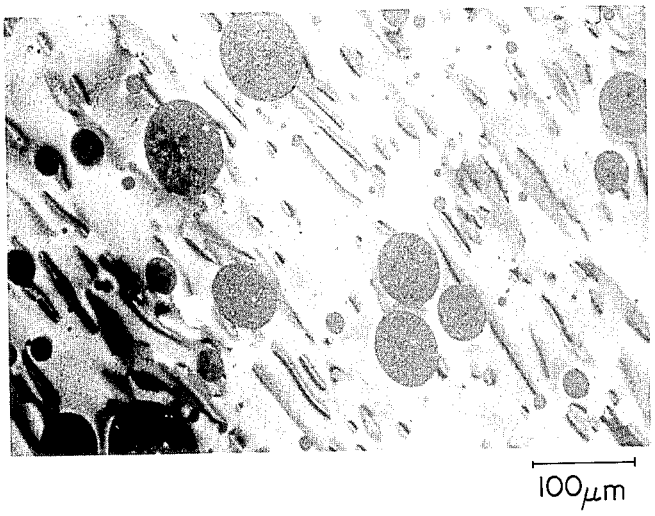

The same filtered coal tar soft pitch as used in Example 3 was taken into a test tube without the pretreatment, and subjected to heat treatment by heating at 470° C. under 10 Torr in a nitrogen atmosphere for 15 minutes, but coked. Thus, the heat treatment temperature was changed to 450° C., and the same soft pitch as above was subjected to heat treatment by heating at 450° C. under 10 Torr in a nitrogen atmosphere, except that the heat treatment time was changed variously, to obtain mesophase pitches having various mesophase contents. The surfaces of the thus obtained mesophase pitches were polished and observed by a polarization microscope. FIG. 8 shows one example thereof, which has about the same mesophase content as that of the mesophase pitch of Example 3.

EXAMPLE 4

100 parts of petroleum pitch (D) having a softening point of 120° C., 5.5% benzene insolubles, a trace of QI, a specific gravity of 1.185 and 0.1% ashes and 50 parts of sec-butanol were charged into an autoclave, and subjected to pretreatment by heating at 430° C. for 30 minutes after the air in the autoclave was replaced with a nitrogen gas and the autoclave was tightly sealed. The pretreatment pressure was 170 kg/cm$^2$ gage.

After the pretreatment, an oil fraction containing unreacted sec-butanol was removed from the resulting mixture by distillation at 300° C. under 35 Torr, whereby a pitch having a softening point of 116° C., 4.8% TI, and a trace of QI was obtained.

Then, the pitch was taken into a test tube, and subjected to heat treatment by heating at 470° C. under 10 Torr in a nitrogen atmosphere for 20 minutes to obtain a mesophase pitch. The surface of the mesophase pitch was polished and observed by a polarization microscope, as given in FIG. 5. It is seen that the mesophase domains are larger than those of FIG. 9.

COMPARATIVE EXAMPLE 4

The same petroleum pitch (D) as used in Example 4 was taken into a test tube without the pretreatment, and subjected to heat treatment by heating at 470° C. under 10 Torr in a nitrogen atmosphere for 20 minutes, but coked. Mesophase pitch could be obtained by heat treatment under the same conditions as above, except that the heat treatment time was changed to 15 minutes. The surface of the thus obtained mesophase pitch was polished and observed by a polarization microscope, as given in FIG. 9.

EXAMPLE 5

100 parts of coal tar pitch (A) having a softening point of 82° C., 11% TI and 0% QI and 50 parts of isopropanol were charged into an autoclave and subjected to pretreatment by heating at 320° C. for 90 minutes after the air in the autoclave was replaced with a nitrogen gas and the autoclave was tightly sealed. The pretreatment pressure was 77 kg/cm$^2$ gage.

After the pretreatment, the resulting mixture was cooled, and a supernatant containing unreacted isopropanol was removed therefrom by decantation. Then, the resulting pitch residue was taken into a flask, and subjected to heat treatment by heating at 470° C. under 6 Torr in a nitrogen atmosphere for 6 minutes to obtain a mesophase pitch. Yield of the mesophase pitch on the basis of the raw material coal tar pitch was 12%, and the mesophase pitch had a softening point of 330° C. and a mesophase content of 92%.

Then, the mesophase pitch was heated at 385° C. and extruded through a nozzle, 0.5 mm in diameter, and wound onto a bobbin, whereby a pitch fiber having a diameter of 9 μm was obtained.

Then, the pitch fiber was thermoset in a hot air, and then heat-treated in an argon atmosphere at 2,500° C., and the resulting graphitized fiber had a Young's modulus as high as 45 Ton/mm$^2$.

EXAMPLE 6

100 parts of the same coal tar pitch as used in Example 5, 2 parts of sec-butanol and 0.02 parts of caustic potash were charged into an autoclave, and subjected to pretreatment by heating at 450° C. for 20 minutes after the air in the autoclave was replaced with a nitrogen gas, and the autoclave was tightly sealed. The pretreatment pressure was 6 kg/cm$^2$ gage.

After the pretreatment and cooling, the resulting mixture was taken directly into a flask without removal of the oil fraction, and subjected to heat treatment by heating at 470° C. under 4 Torr in a nitrogen atmosphere for 3 minutes to obtain a mesophase pitch. The mesophase pitch had a yield of 15% on the basis of the raw material coal tar pitch, a softening point of 308° C. and a mesophase content of 78%.

Then, the mesophase pitch was heated at 360° C., extruded from a nozzle, 0.5 mm in diameter, and wound onto a bobin, whereby a pitch fiber having a diameter of 11 μm was obtained.

COMPARATIVE EXAMPLE 5

The same coal tar pitch as used in Example 5 was treated under the same conditions as in Examples 5 and 6 without the addition of the alcohols. The mesophase pitch obtained in the same conditions as in Example 5 had a softening point of more than 400° C. and a substantially 100% mesophase content.

Under the same conditions as in Example 6, coking took place during the heat treatment. Thus, mesophase pitches were produced at a heat treatment temperature of 450° under 4 Torr in a nitrogen atmosphere, while changing the heat treatment time variously. The thus obtained mesophase pitches having the approximately same mesophase contents as those of Examples 5 and 6, that is, 92% and 78%, respectively, had softening points of 385° C. and 375° C., respectively, and both could not be spun into fibers.

EXAMPLE 7

100 parts of the same coal tar pitch (B) as used in Example 2, and 100 parts of phenol were charged into an autoclave and subjected to pretreatment by heating at 375° C. for 90 minutes, after the air in the autoclave was replaced with a nitrogen atmosphere and the autoclave was tightly sealed. The pretreatment pressure was 23 kg/cm$^2$ gage.

After the pretreatment, the resulting mixture was distilled at 300° C. under 10 Torr to remove an oil fraction therefrom, and a pretreated pitch was obtained thereby.

The pretreated pitch was subjected to heat treatment by heating at 470° C. under 6 Torr in a nitrogen atmosphere for 8 minutes to obtain a mesophase pitch. The mesophase pitch had a yield of 9% on the basis of the raw material coal tar pitch, a softening point of 353° C. and a substantially 100% mesophase content.

Then, the mesophase pitch was heated at 380° C., extruded through a nozzle, 0.5 mm in diameter, and wound onto a bobin, whereby a pitch fiber having a diameter of 12 μm was obtained.

The pitch fiber was thermoset in a hot air and then heat-treated in an argon atmosphere at 2,500° C. and the resulting graphitized fiber had a Young's modulus as high as 47 Ton/mm$^2$.

EXAMPLE 8

100 parts of the same coal tar pitch (B) as used in Example 2, 5 parts of cresol and 0.05 parts of caustic potah were charged into an autoclave, and subjected to pretreatment by heating at 320° C. for 20 minutes, after the air in the autoclave was replaced with a nitrogen gas, and the autoclave was tightly sealed. The pretreatment pressure was 8 kg/cm$^2$ gage.

After the pretreatment, the pretreated mixture was cooled and taken directly into a flask without removal of an oil fraction and subjected to heat treatment by heating at 470° C. under 4 Torr in a nitrogen atmosphere for 5 minutes to obtain a mesophase pitch. The mesophase pitch had a yield of 10% on the basis of raw material coal tar pitch, a softening point of 330° C. and a mesophase content of 80%.

Then, the mesophase pitch was heated at 375° C., extruded through a nozzle, 0.5 mm in diameter, and wound onto a bobbin, whereby a pitch fiber having a diameter of 10 μm was obtained.

The pitch fiber was thermoset in a hot air, and then heat treated in an argon atmosphere at 2,500° C., and the resulting graphitized fiber had a Young's modulus as high as 40 Ton/mm$^2$.

COMPARATIVE EXAMPLE 6

The same coal tar pitch (B) as used in Example 2 was heat-treated under the same conditions as in Examples 7 and 8 without pretreatment with phenol and cresol. Under the conditions of Example 7, coking took place during the heat treatment. Under the conditions of Example 8, the resulting mesophase pitch had a softening point of 384° C. and a mesophase content of 90%. Then, mesophase pitches were produced by heat treatment by heating at 450° C. under 4 Torr in a nitrogen atmosphere while changing the heat treatment time variously. The thus produced mesophase pitches having the same mesophase contents as in Examples 7 and 8, that is, 100% and 80%, respectively, had softening points of 395° C. and 372° C., respectively, and both could not been spun into fibers.

EXAMPLE 9

The same coal tar pitch as used in Example 6 was pretreated under the same conditions as in Example 6, except that no caustic potash was added, and the pretreated mixture was subjected to heat treatment under the same conditions as in Example 6 without removal of the oil fraction to obtain a mesophase pitch. The mesophase pitch had a softening point of 332° C., which was by 24° C. higher than that of Example 6.

As described in detail above, the present invention provides a process for producing a mesophase pitch for high performance carbon products by adding at least one of an alcohol and a phenol to heavy bitumens, and conducting pretreatment of the resulting mixture by heating, and then conducting heat treatment of the resulting pretreated mixture, and also provides carbon products, particularly carbon fibers produced from such a mesophase pitch. Thus, the present invention has a great industrial significance.

What is claimed is:

1. A process for producing a mesophase pitch for carbon products, which comprises adding one part to 200 parts by weight of at least one of an alcohol and a phenol to 100 parts by weight of heavy bitumens, subjecting the resulting mixture to pretreatment by heating at least at 250° C. under pressure, and then subjecting the pretreated mixture to heat treatment until mesophases are formed.

2. A process for producing a mesophase pitch for carbon products, which comprises adding one part to 200 parts by weight of an alcohol to 100 parts by weight of heavy bitumens, subjecting the resulting mixture to pretreatment by heating at 250° C. to 550° C. under pressure, and then subjecting the pretreated mixture to heat treatment until mesophases are formed.

3. A process according to claim 1 or 2, wherein the heavy bitumens is coal tar, coal-liquefied heavy oil, petroleum-topping residues, petroleum-cracking residues or pitch fraction prepared therefrom.

4. A process according to claim 1 or 2, wherein the alcohol is a saturated alcohol, an unsaturated alcohol, a halogenoalcohol, a polyhydric alcohol, an aminoalcohol, or a mixture thereof.

5. A process according to claim 1 or 2, wherein the alcohol is methanol, ethanol, propanol, butanol, pentanol, hexanol, heptanol, octanol, allyl alcohol, ethylenechlorohydrin, ethyleneglycol, diethyleneglycol, triethyleneglycol, glycerine, ethanolamine, or a mixture thereof.

6. A process according to claim 1, wherein the phenol is a monohydric phenol, a dihydric phenol, a polyhydric phenol, or a mixture thereof.

7. A process according to claim 1, wherein the phenol is phenol, cresol, xylenol, resorcinol, hydroquinone, hydroxyhydroquinone, or a mixture thereof.

8. A process according to claim 1 or 2, where the pretreatment is carried out under the pressure of at least an autogeneous pressure.

9. A process according to claim 1, or 2, wherein the pretreatment is carried out at 300° to 550° C., under pressure for at least 5 minutes.

10. A process according to claim 8 or 9, wherein the pretreatment is carried out above an autogeneous pressure of at least one of the alcohol and the phenol.

11. A process according to claim 1 or 2, wherein the pretreatment is carried out under an addition of 0.01 to 5 parts by weight of a basic substance per 100 parts by weight of heavy bitumens.

12. A process according to claim 11, wherein the basic substance is caustic alkali, alkali carbonate or tar base.

13. A process according to claim 1, or 2, wherein the heat treatment is carried out after removing unreacted, alcohol, unreacted phenol and/or oil from the pretreated mixture.

* * * * *